US005221240A

United States Patent [19]

Mann et al.

[11] Patent Number: 5,221,240

[45] Date of Patent: Jun. 22, 1993

[54] DOOR GYM APPARATUS

[76] Inventors: Karen L. Mann; Gary E. Mann, both of 13513 Hwy. C., Valders, Wis. 54245

[21] Appl. No.: 900,670

[22] Filed: Jun. 19, 1992

[51] Int. Cl.[5] ..... A63B 3/00

[52] U.S. Cl. ..... 482/40; 482/42; 482/38; 482/129

[58] Field of Search ..... 482/38, 39, 40, 41, 482/42, 129, 121, 122, 126

[56] References Cited

U.S. PATENT DOCUMENTS

| | | | |
|---|---|---|---|
| 1,401,476 | 12/1921 | Jordan et al. | 482/40 |
| 2,594,605 | 4/1952 | Zoppelt | 482/40 |
| 2,637,555 | 5/1953 | Klaudt | 482/40 |
| 2,919,134 | 12/1959 | Zuro | 482/38 |
| 4,529,191 | 7/1985 | Miller et al. | 482/40 |
| 4,844,448 | 7/1989 | Niznik | 482/129 |
| 5,029,850 | 7/1991 | Van Straaten | 482/122 |

FOREIGN PATENT DOCUMENTS

| | | | |
|---|---|---|---|
| 2045699 | 3/1972 | Fed. Rep. of Germany | 482/129 |
| 1216347 | 4/1960 | France | 482/40 |

*Primary Examiner*—Richard J. Apley
*Assistant Examiner*—Lynne A. Reichard
*Attorney, Agent, or Firm*—Leon Gilden

[57] ABSTRACT

A door gym apparatus includes upper and lower mounts of telescoping configuration having swivel caps at their distal ends formed with C-shaped mounting clamp structure, wherein the mounting clamp structure includes friction pads to engage surfaces within a doorway or opposing wall surface within a hallway and the like within a dwelling. First and second guide loops mounted to the upper mount include first and second tether lines directed therethrough, wherein the tether lines have at their lower ends pivotal securement to elastomeric first and second resilient webs, with the tether lines having handle to permit manual grasping for exercise purposes.

4 Claims, 4 Drawing Sheets

DOOR GYM APPARATUS

BACKGROUND OF THE INVENTION

1. Field of the Invention

The field of invention relates to exercise apparatus, and more particularly pertains to a new and improved door gym apparatus wherein the same is arranged for selective mounting within a door framework of a dwelling.

2. Description of the Prior Art

Various exercise apparatus is available in the prior art for positioning and orientation for use positioned in doorways and such is exemplified in the U.S. Pat. No. 4,861,020 to Soligny, Sr.

Further portable gym apparatus is addressed for positioning upon an underlying support surface as set forth in the U.S. Pat. Nos. 3,472,509; 3,664,666; 4,257,590; and 4,826,153.

Heretofore, however, the prior art has failed to provide for the ease of mounting of a gym organization as set forth by the instant invention and in this respect, the present invention substantially fulfills this need.

SUMMARY OF THE INVENTION

In view of the foregoing disadvantages inherent in the known types of gym apparatus now present in the prior art, the present invention provides a door gym apparatus wherein the same utilizes telescoping leg members for mounting within a door framework. As such, the general purpose of the present invention, which will be described subsequently in greater detail, is to provide a new and improved door gym apparatus which has all the advantages of the prior art gym apparatus and none of the disadvantages.

To attain this, the present invention provides a door gym apparatus including upper and lower mounts of telescoping configuration having swivel caps at their distal ends formed with C-shaped clamp structure, wherein the mounting clamp structure includes friction pads to engage surfaces within a doorway or opposing wall surface within a hallway and the like within a dwelling. First and second guide loops mounted to the upper mount include first and second tether lines directed therethrough, wherein the tether lines have at their lower ends pivotal securement to elastomeric first and second resilient webs, with the tether lines having handle to permit manual grasping for exercise purposes.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door gym apparatus which has all the advantages of the prior art gym apparatus and none of the disadvantages.

It is another object of the present invention to provide a new and improved door gym apparatus which may be easily and efficiently manufactured and marketed.

It is a further object of the present invention to provide a new and improved door gym apparatus which is of a durable and reliable construction.

An even further object of the present invention is to provide a new and improved door gym apparatus which is susceptible of a low cost of manufacture with regard to both materials and labor, and which accordingly is then susceptible of low prices of sale to the consuming public, thereby making such door gym apparatus economically available to the buying public.

Still yet another object of the present invention is to provide a new and improved door gym apparatus which provides in the apparatuses and methods of the prior art some of the advantages thereof, while simultaneously overcoming some of the disadvantages normally associated therewith These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
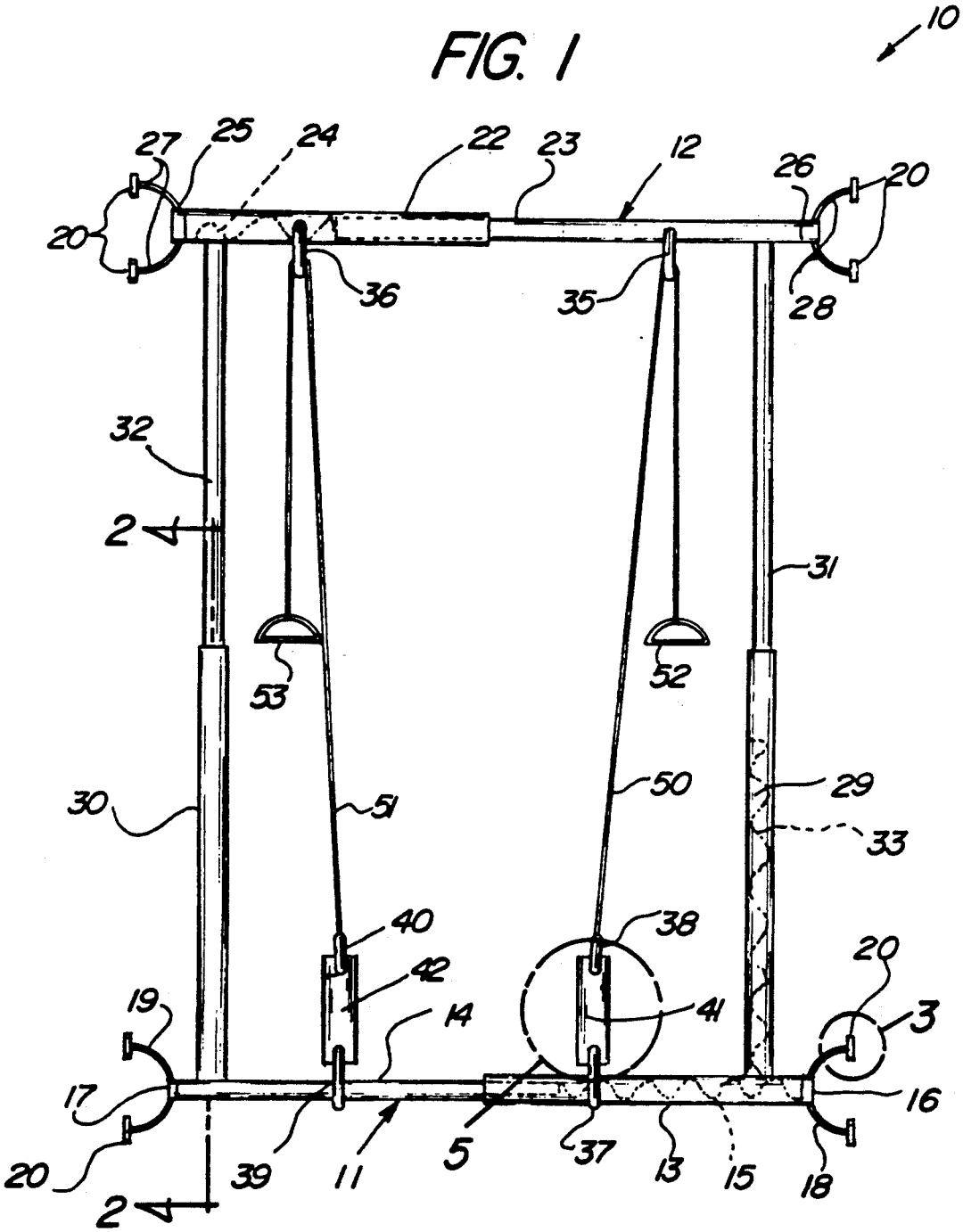
FIG. 1 is an orthographic view of the instant invention.
Figure 2:
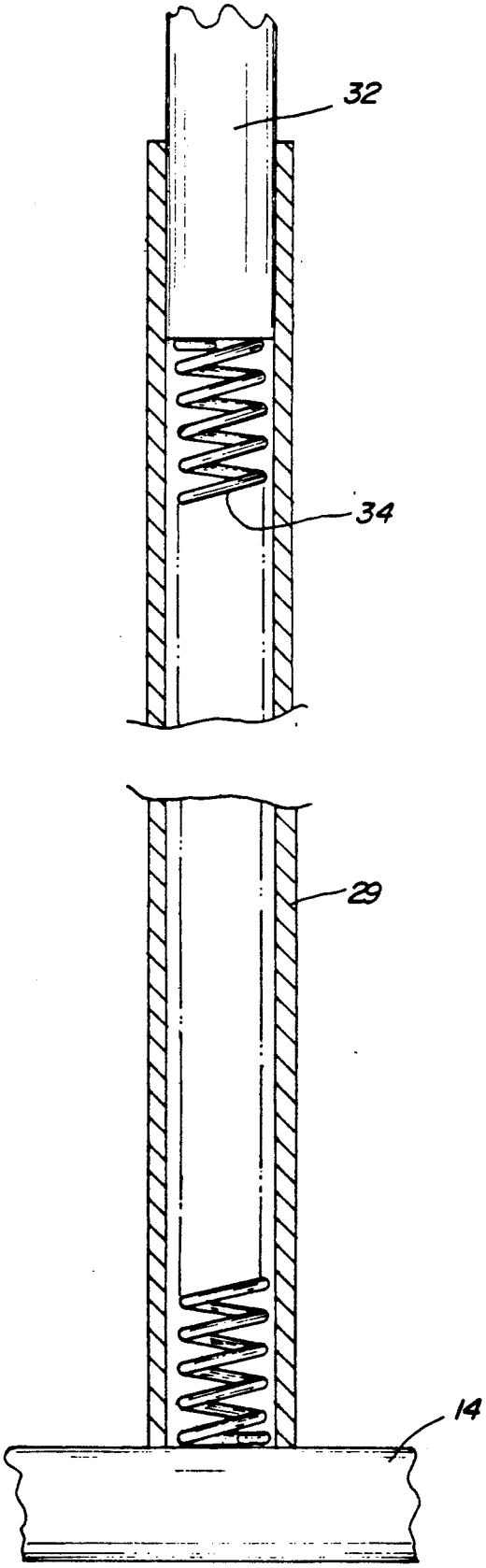
FIG. 2 is an orthographic view, taken along the lines 2—2 of FIG. 1 in the direction indicated by the arrows.
Figure 3:
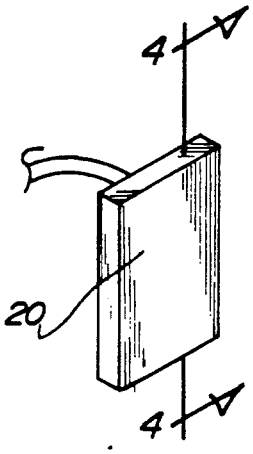
FIG. 3 is an enlarged isometric illustration of section 3 as set forth in FIG. 1.
Figure 4:
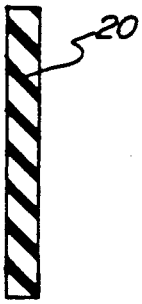
FIG. 4 is an orthographic view, taken along the lines 4—4 of FIG. 3 in the direction indicated by the arrows.
Figure 5:
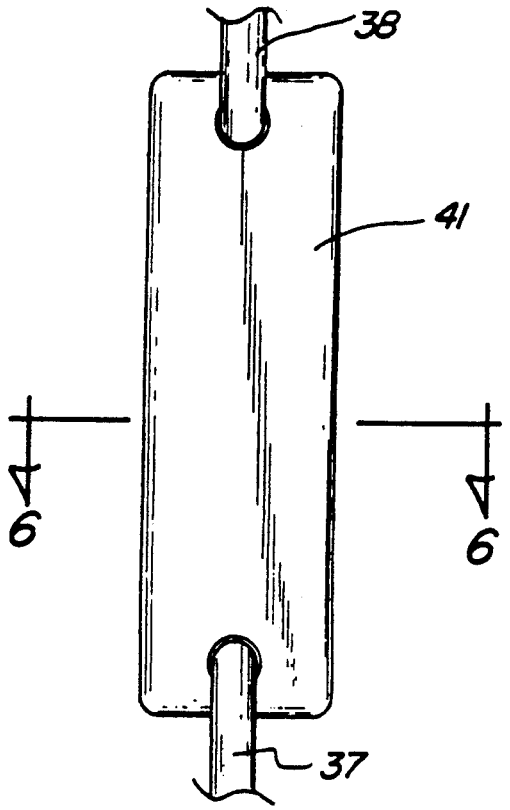
FIG. 5 is an orthographic view of section 5, as set forth in FIG. 1.
Figure 6:
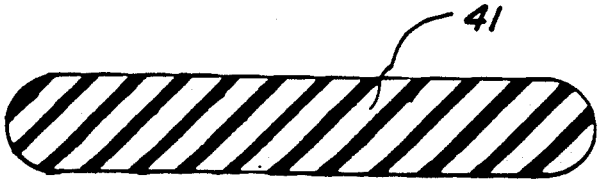
FIG. 6 is an orthographic view, taken along the lines 6—6 of FIG. 5 in the direction indicated by the arrows.

With reference now to the drawings, and in particular to FIGS. 1 to 9 thereof, a new and improved door gym apparatus embodying the principles and concepts of the present invention and generally designated by the reference numeral 10 will be described.

More specifically, the door gym apparatus 10 of the instant invention essentially comprises a lower mount 11 arranged parallel to in a spaced coextensive relationship relative to an upper mount 12. The lower mount includes a lower mount first tube 13 telescopingly receiving a lower mount second tube 14. A lower mount spring 15 is interposed within the lower mount first tube to bias the lower mount second tube 14 exteriorly thereof in a coaxially aligned relationship. A lower mount first tube swivel cap 16 and a lower mount second swivel cap 17 are mounted at the distal ends of the respective first and second lower mount tubes 13 and 14 mounting respective lower first and second tube swivel cap legs 18 and 19 defining a C-shaped configuration, with each leg having a friction plate 20 mounted thereon, wherein each friction plate 20 is oriented generally orthogonally relative to the axis of the lower mount 11. The upper mount 12 includes an upper mount first tube 22 telescopingly receiving an upper mount second tube 23 having an upper mount spring 24 positioned within the upper mount first tube to bias the upper mount second tube 23 exteriorly thereof in a projecting manner. Upper mount first and second tube swivel caps 25 and 26 are mounted at the distal ends of the upper mount first and second tubes 22 and 23 having respective upper first and second tube swivel cap legs 27 and 28 of C-shaped configurations on the first and second tube swivel caps 25 and 26, and each leg including one of the friction plates 20 oriented therealong, wherein the friction plates 20 and the upper mount are also oriented orthogonally relative to the axis of the upper mount.

First and second base tubes 29 and 30 are orthogonally mounted relative to the respective lower mount first and second tubes 13 and 14, with the first and second base tubes 29 and 30 arranged in a parallel coextensive relationship relative to one another having respective first and second extension tubes 31 and 32 telescopingly and coaxially aligned within the first and second base tubes 29 and 30, to include first and second extension tubes 31 and 32 positioned within the first and second base tubes 29 and 30 to project the first and second extension tubes relative to the first and second base tubes, with the first and second extension tubes mounted orthogonally and fixedly to the respective upper mount first and second tubes 23 and 22.

First and second guide loops 35 and 36 are fixedly mounted in a spaced relationship to the respective upper mount second and first tubes 23 and 21, with the first guide loop 35 cooperative with a respective first lower and upper anchor ring 37 and 38 that include a web therebetween. The lower anchor ring 37 is mounted to the lower mount first tube 13. Second lower and upper anchor rings 39 and 40 are provided, with the second lower anchor ring 39 mounted to the lower mount second tube 14, and including a second resilient web 42 between the second lower and upper anchor 39 and 40. The resilient webs 41 and 42 are each formed of a shape retentent material deformable to exert tension in their return upon deflection from a non-tension state, wherein respective first and second tether lines 50 and 51 are provided, with the first and second tether line 50 and 51 mounted to the respective first and second upper anchor rings 38 and 40. The first and second tether lines directed through the respective first and second guide loops 35 and 36 have respective first and second handles 52 and 53 mounted at second ends of the respective tether lines to permit individuals to exert tension upon the respective resilient webs 41 and 42.

Figure 7:
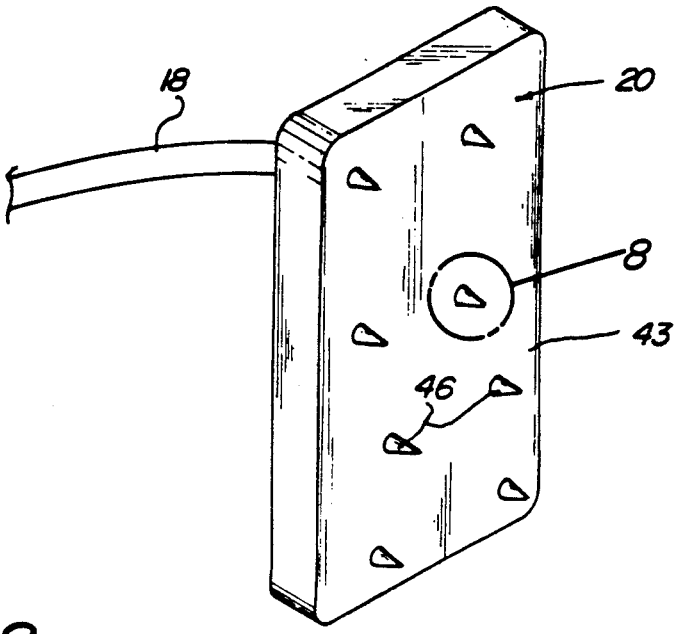
FIG. 7 is an enlarged isometric illustration of the friction plate structure in modified construction.
Figure 8:
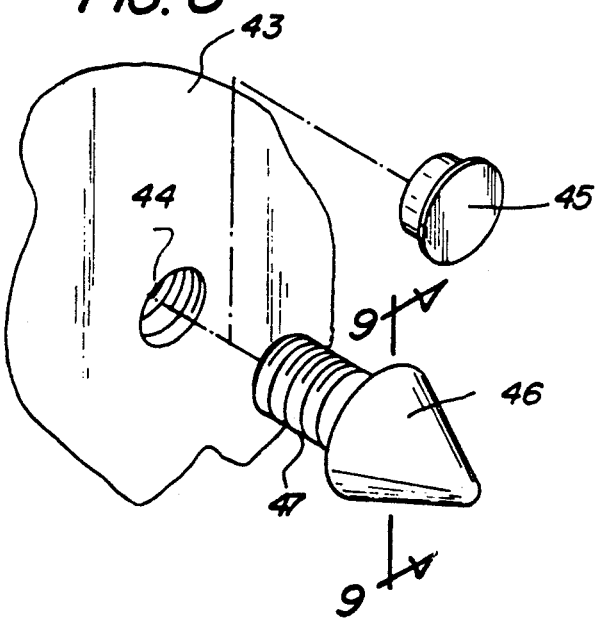
FIG. 8 is an enlarged isometric illustration of section 8 as set forth in FIG. 7.
Figure 9:
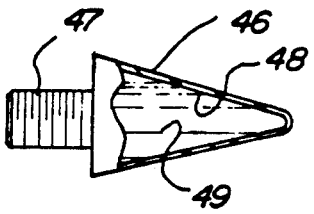
FIG. 9 is an orthographic view, taken along the lines 9—9 of FIG. 8 in the direction indicated by the arrows.

The FIGS. 7-9 indicate the use of modified friction plates having each a friction plate planar engagement face 43 oriented orthogonally relative to the axes of the upper and lower mounts, with each engagement face 43 including a matrix of internally threaded bores 44 to threadedly receive a threaded shank 47, or alternatively a pug member 45 when use of the associated threaded shanks 47 are not desired, wherein each threaded shank 47 includes a conical engagement head 46 to prevent marring of an engagement face, such as within a doorway or hallway of a dwelling. Each conical engagement head 46 includes a head cavity 48 containing a compressible gel 49 therewithin to enhance frictional engagement, while simultaneously minimizing abrasiveness relative to an engagement surface to be impinged upon by the friction plates 20.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A door gym apparatus, comprising, an upper mount spaced from, parallel to, and coextensive with a lower mount, and the upper mount including a first tube telescopingly receiving an upper mount second tube in a coaxially aligned telescoping relationship, with an upper mount spring mounted within the upper mount first tube to bias the upper mount second tube relative to the upper mount first tube, the upper mount first tube including a first tube swivel cap, and the upper mount second tube including an upper mount second swivel cap, the first swivel cap and the second swivel cap each including a pair of swivel cap legs defining a C-shaped configuration, and each swivel cap leg of each pair of swivel cap legs includes a friction plate member, the lower mount includes a lower mount first tube telescopingly receiving a lower mount second tube in a coaxially aligned relationship, with a lower mount spring mounted within the lower mount first tube to bias the lower mount second tube relative to the lower mount first tube, with the lower mount first tube including a lower mount first swivel cap and the lower mount second tube including a lower mount second swivel cap, wherein the lower mount first swivel cap and the lower mount second swivel cap are coaxially aligned, and each include a pair of lower mount swivel cap legs, each defining a C-shaped configuration and each leg of the lower mount swivel cap legs includes a further friction plate, and a first guide loop mounted to the upper mount second tube, and a second guide loop mounted to the upper mount first tube, and first resistance means mounted to the lower mount first tube, and second resistance means mounted to the lower mount second tube, wherein the first resistance means and second resistance means include respective first tether line and a second tether line directed through the respective first guide loop and the second guide loop for biasing the first tether line and the second tether line towards the first resistance means and the second resistance means.

2. An apparatus as set forth in claim 1 wherein the first resistance means includes a lower anchor ring mounted to the lower mount first tube, and a first resilient web mounted to the first lower anchor ring, and a first upper anchor ring mounted to the first resilient web spaced from the first lower anchor ring, and the first tether line mounted to the first upper anchor ring at a first end of the first tether line, with a second end of the first tether line having a first handle, and mounted to the lower mount second tube and including a second upper anchor ring, with the second resilient web mounted between the second lower anchor ring and the second upper anchor ring, and the second tether line including a second tether line first end secured to the second upper anchor ring, and the second tether line further including a second tether line second end having a second handle secured thereto.

3. An apparatus as set forth in claim 2 including a first base tube fixedly and orthogonally mounted to the lower mount first tube, and a second base tube arranged parallel and coextensive relative to the first base tube, with the second base tube fixedly and orthogonally mounted to the lower mount second tube, and a first extension tube mounted telescopingly within the first base tube, and a second extension tube telescopingly mounted within the second base tube, and a first extension tube spring positioned within the first base tube to bias a first extension tube relative to the first base tube, and a second extension spring mounted within the second base tube to bias the second extension tube relative to the second base tube, with the first base tube fixedly and orthogonally mounted to the upper mount second tube and the second extension tube fixedly and orthogonally mounted to the upper mount first tube, with the first extension tube and second extension tube arranged in a parallel coextensive relationship relative to one another.

4. An apparatus as set forth in claim 3 wherein each friction plate includes a matrix of threaded bores, and at least one of said threaded bores includes a threaded shank, and the threaded shank including a conical engagement head projecting exteriorly of each friction plate, and each conical head including a conical head cavity, and each conical head cavity including a compressible gel contained therewithin.

* * * * *